US008926348B2

(12) United States Patent
Ma

(10) Patent No.: US 8,926,348 B2
(45) Date of Patent: Jan. 6, 2015

(54) MOUNTING APPARATUS FOR MEMORY CARD HAVING A HOLDING PORTION CONNECTED TO A PIVOTALLY MOUNTED FIXING PORTION

(71) Applicants: Hong Fu Jin Precision Industry (ShenZhen) Co., Ltd., Shenzhen (CN); Hon Hai Precision Industry Co., Ltd., New Taipei (TW)

(72) Inventor: Xiao-Feng Ma, Shenzhen (CN)

(73) Assignees: Hong Fu Jin Precision Industry Co., Ltd., New Taipei (TW); Hon Hai Precision Industry Co., Ltd., New Taipei (TW)

( * ) Notice: Subject to any disclaimer, the term of this patent is extended or adjusted under 35 U.S.C. 154(b) by 39 days.

(21) Appl. No.: 13/850,279

(22) Filed: Mar. 25, 2013

(65) Prior Publication Data

US 2014/0273647 A1 Sep. 18, 2014

(30) Foreign Application Priority Data

Mar. 18, 2013 (CN) ..... 2013 1 0085242

(51) Int. Cl.
*H01R 13/62* (2006.01)
*H01R 12/72* (2011.01)

(52) U.S. Cl.
CPC ..... *H01R 12/72* (2013.01)
USPC ..... 439/160

(58) Field of Classification Search
CPC .. H01R 13/631; H01R 13/633; H01R 13/635; H01R 13/6315; H01R 13/6335; H01R 23/7005; H01R 23/7068
See application file for complete search history.

(56) References Cited

U.S. PATENT DOCUMENTS

| | | | | |
|---|---|---|---|---|
| 4,345,809 | A * | 8/1982 | Sugden | 439/160 |
| 6,056,579 | A * | 5/2000 | Richards et al. | 439/358 |
| 6,227,887 | B1 * | 5/2001 | Choy | 439/160 |
| 7,641,495 | B1 * | 1/2010 | Sun | 439/327 |
| 8,157,576 | B2 * | 4/2012 | Fu et al. | 439/153 |
| 8,254,123 | B2 * | 8/2012 | Sun | 361/695 |
| 8,550,836 | B2 * | 10/2013 | Ma et al. | 439/328 |
| 8,684,757 | B2 * | 4/2014 | Bridges et al. | 439/196 |
| 2012/0325758 | A1 * | 12/2012 | Ma et al. | 211/26 |

* cited by examiner

*Primary Examiner* — Chandrika Prasad
(74) *Attorney, Agent, or Firm* — Novak Druce Connolly Bove + Quigg LLP

(57) ABSTRACT

A mounting apparatus includes a connector and a fixing member. The connector defines a memory slot to receive a bottom side of a memory card. The fixing member includes a fixing portion pivotably mounted to the connector, and a holding portion connected to the fixing portion. The holding portion includes an arm defining a receiving slot to receive an end of the memory card, and a top wall binding a top end of the receiving slot. The fixing portion is rotated down relative to the connector to a position such that the holding portion is pulled down to allow the top wall to abut against a top side of the memory slot. When the fixing portion is rotated upward relative to the connector, the holding portion is allowed to move upward to disengage the top wall from the memory card.

6 Claims, 4 Drawing Sheets

MOUNTING APPARATUS FOR MEMORY CARD HAVING A HOLDING PORTION CONNECTED TO A PIVOTALLY MOUNTED FIXING PORTION

BACKGROUND

1. Technical Field

The present disclosure relates to mounting apparatus and, particularly, to a mounting apparatus for a memory card.

2. Description of Related Art

Memory cards are often installed in electronic devices, such as computers or servers, using a mounting apparatus. The mounting apparatus includes two opposite fixing plates for clamping two opposite ends of the memory card. Each fixing plate includes an operation portion to operate the plate, which may block airflow to the memory card. In a chassis having a plurality of memory cards arranged in parallel, heat produced by the memory cards can only be dissipated through the narrow spaces between the cards, which is inefficient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
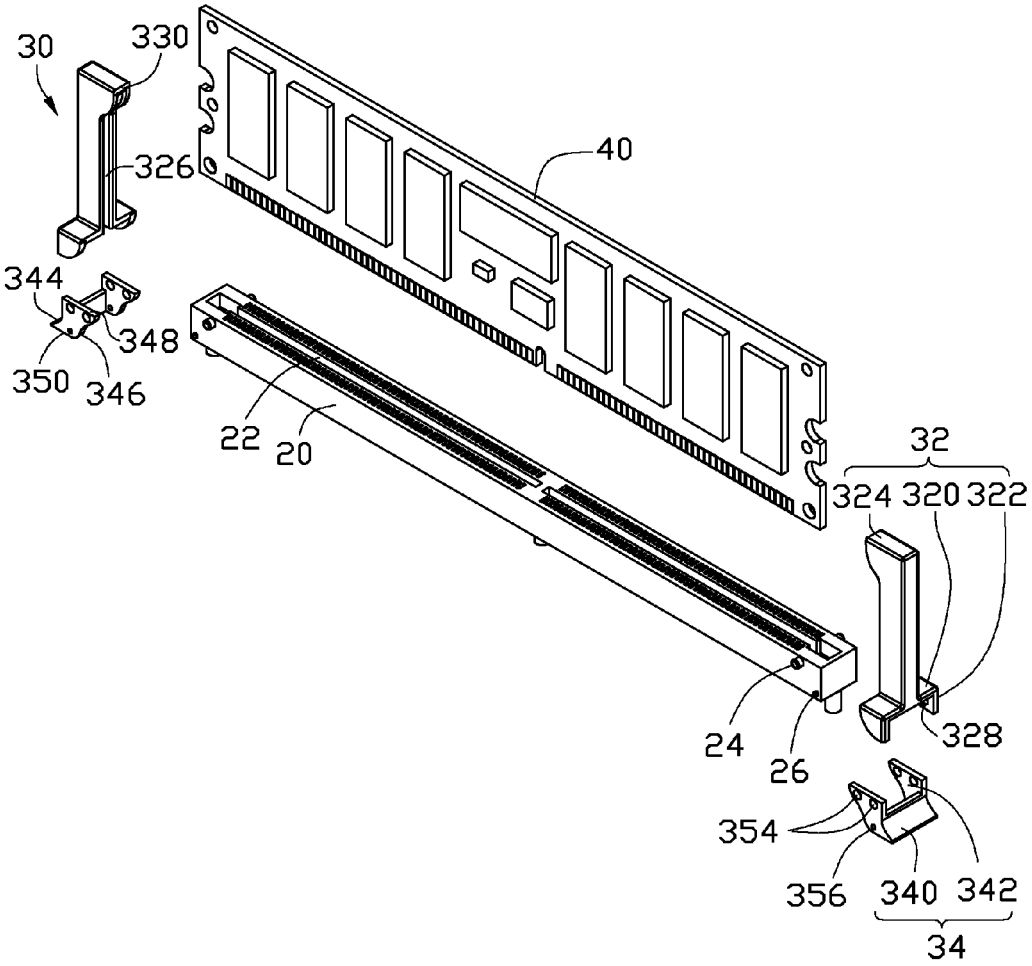
FIG. 1 is an exploded, isometric view of an embodiment of a mounting apparatus, together with a memory card.
Figure 4:
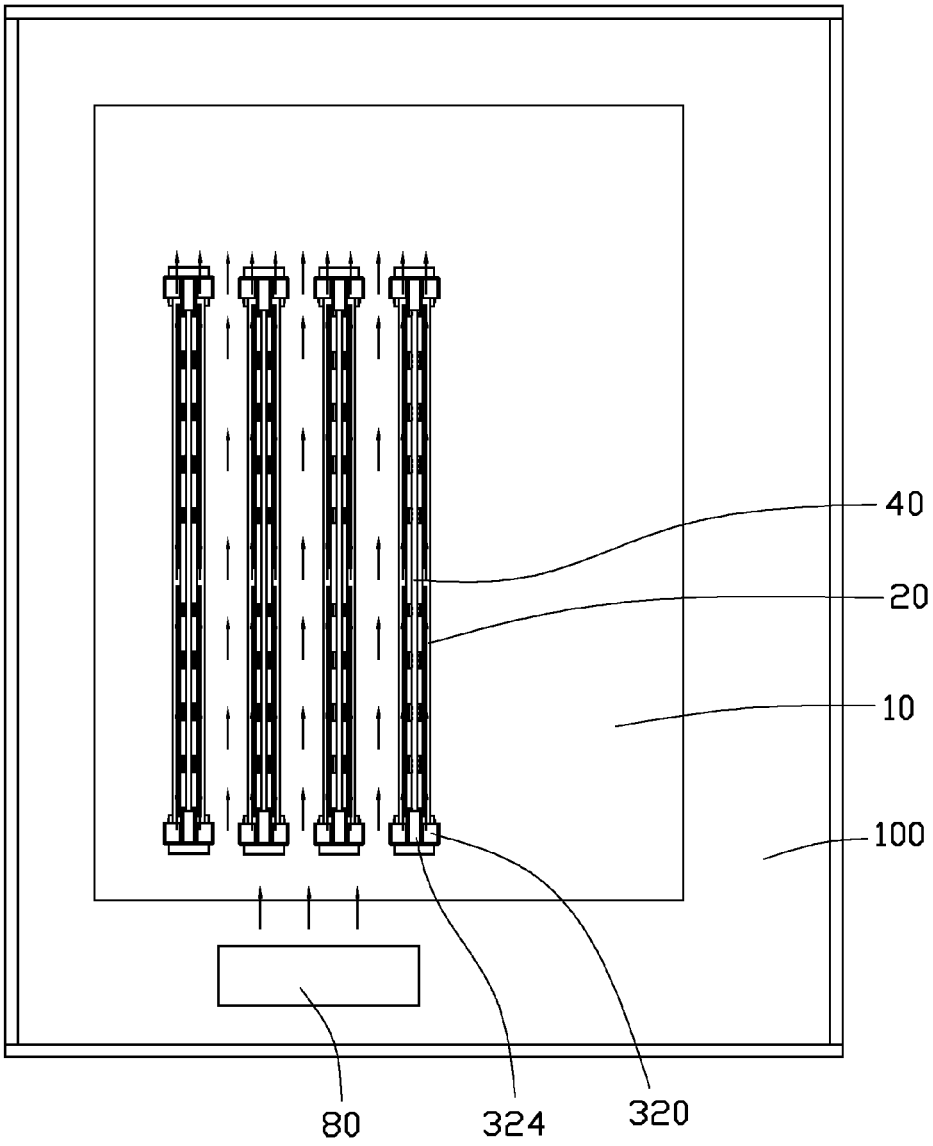
FIG. 4 is a schematic top plan view showing the mounting apparatus of FIG. 1 applied in an electronic system.

FIG. 1 is one embodiment of a mounting apparatus for mounting a memory card 40 to a printed circuit board (PCB) 10 of an electronic device 100 (shown in FIG. 4). A plurality of fans 80 is mounted in the electronic device 100 to cool the memory card 40.

The mounting apparatus includes a connector 20 installed on the PCB 10, and two fixing members 30.

The connector 20 is elongated, and longitudinally defines a slot 22 in a top surface for electrically receiving the memory card 40. Four pins 24 protrude from opposite ends of opposite sides of the connector 20. Four projections 26 protrude from the connector 20. The projections 26 are respectively located below the pins 24, closer to corresponding ends of the connector 20 than the corresponding pin 24.

Each fixing member 30 includes a holding portion 32 and a fixing portion 34.

The holding portion 32 includes a connecting piece 320, two installing pieces 322 extending down from opposite ends of the connecting piece 320, and an arm 324 perpendicularly extending up from a top of the connecting piece 320. The arm 324 defines a receiving slot 326 in one of opposite sides. The holding portion 32 further includes a top wall 330 to bound a top end of the receiving slot 326 opposite to the connecting piece 320. A protrusion 328 protrudes from an inner surface of each installing piece 322 toward the other installing piece 322.

The fixing portion 34 includes a slanted operation piece 340, and two extension pieces 342 connected to opposite ends of the operation piece 340 and parallel to each other. Each extension piece 342 includes a first side 344, a second side 346 opposite to the first side 344, a first end 348 connected between top ends of the first side 344 and the second side 346, and a second end 350 connected between bottom ends of the first side 344 and the second side 346. A lower portion of the first side 344 is connected to the operation piece 340. A lower portion of the second side 346 is arc-shaped. Two installing holes 354 are defined in each extension piece 342, adjacent to opposite ends of the first end 348. A through hole 356 is defined in each extension piece 342 adjacent to the lower portion of the second side 346.

Figure 2:
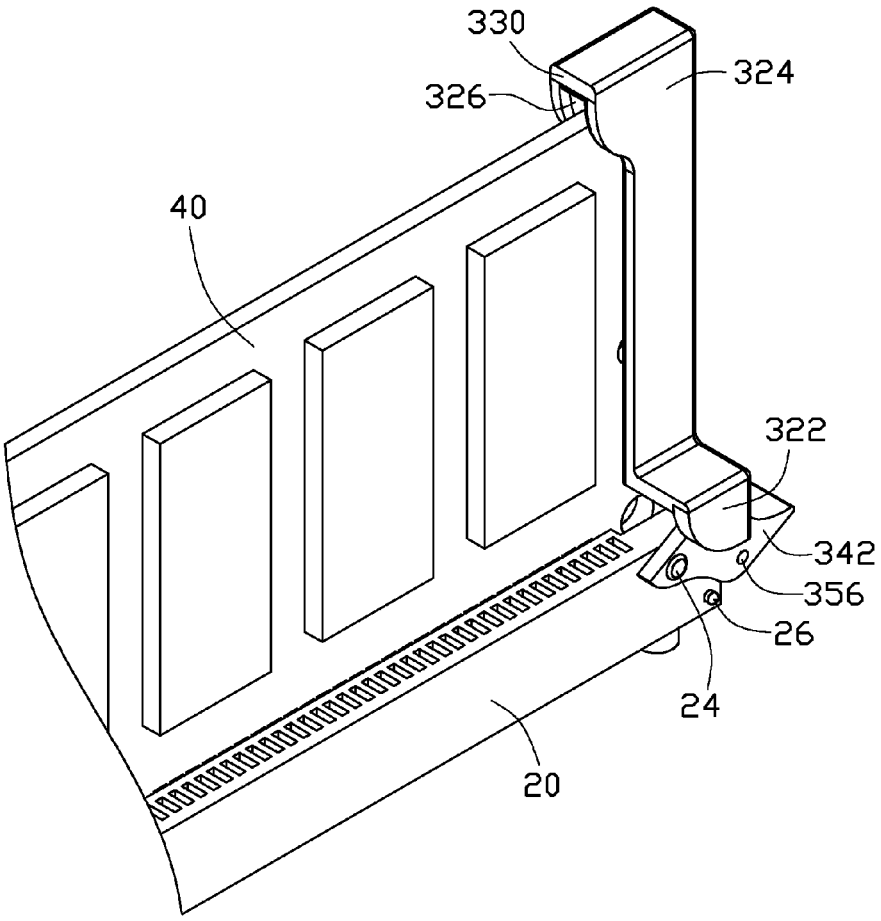
FIG. 2 is a partially assembled, isometric view of FIG. 1.
Figure 3:
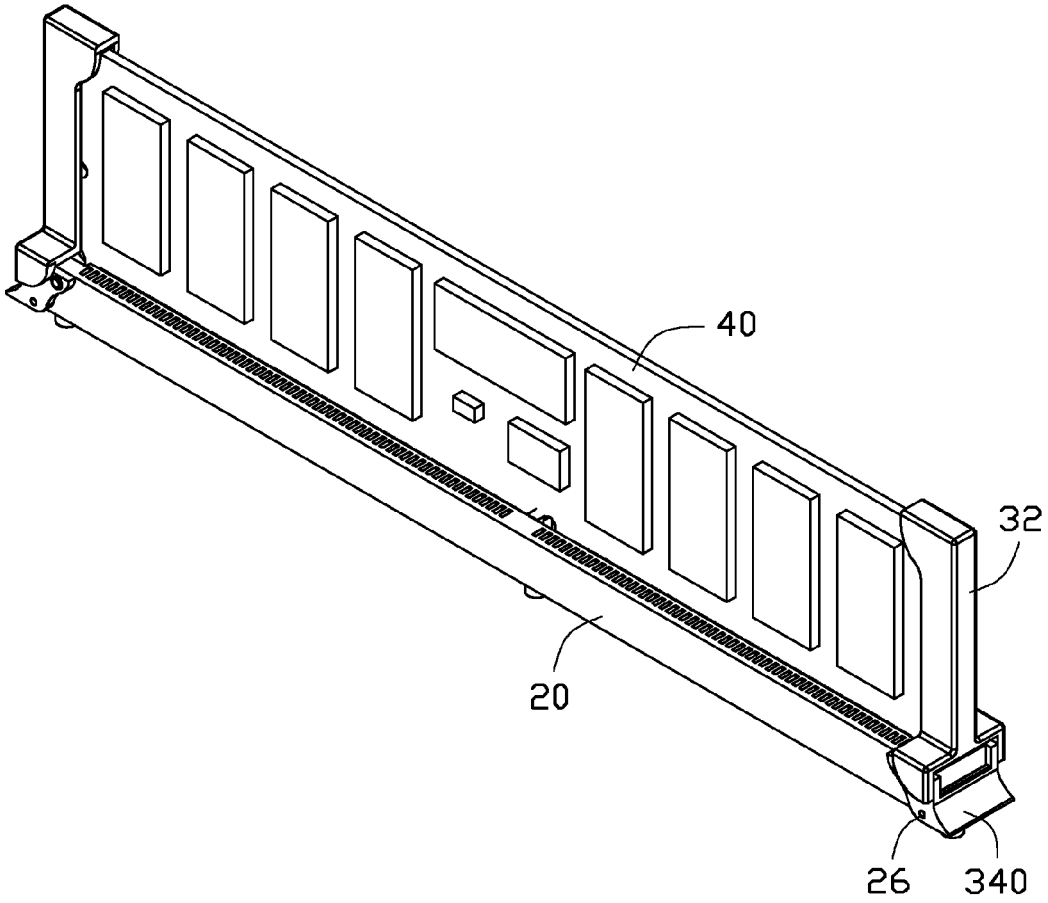
FIG. 3 is an assembled, isometric view of FIG. 2.

Referring to FIGS. 2 and 3, in assembling each fixing member 30, the protrusions 328 are pivotably inserted into the installing holes 354 adjacent to the operation piece 340, to pivotably mount the holding portion 32 to the fixing portion 34, with the receiving slot 326 facing away from the operation piece 340.

In mounting the fixing members 30 to the connector 20, the pins 24 of each end of the connector 20 are pivotably inserted into the installing holes 354 of one of the fixing members 30 away from the operation piece 340, to pivotably mount the fixing member 30 to the connector 20. At this time, the operation pieces 340 are positioned above the connector 20.

In fixing the memory card 40, a bottom side of the memory card 40 is inserted into the slot 22. The holding portions 32 are pivoted toward the connector 20, until opposite ends of the memory card 40 are received in the receiving slots 326. At this time, the top walls 330 do not contact a top side of the memory card 40 away from the connector 20. The operation pieces 340 are then rotated down and toward the connector 20. Therefore, the holding portions 32 are moved downward. When the projections 26 are engaged in the corresponding through holes 356, the top walls 330 abut against the top side of the memory card 40, thereby fixing the memory card 40 to the connector 20. At this time, the fixing portions 34 are fixed to the connector 20 and are positioned below the top surface of the connector 20. Therefore, the airflow from the fans 80 will not blocked by the operation pieces 340 and can effectively dissipate heat for the memory card 40.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A mounting apparatus for fixing a memory card, comprising:

a connector defining a memory slot in a top surface to receive a bottom side of the memory card; and a fixing member comprising a fixing portion pivotably mounted to an end of the connector and a holding portion connected to the fixing portion; the holding portion comprising an arm defining a receiving slot to receive an end of the memory card and a top wall bounding a top end of the receiving slot;

wherein when fixing the memory card to the connector, the fixing portion is rotated down relative to the connector to a position such that the holding portion is pulled down to allow the top wall to abut against a top side of the memory slot; and when disengaging the memory card from the connector, the fixing portion is rotated up relative to the connector such that the holding portion is allowed to move upward to disengage the top wall from the memory card.

2. The mounting apparatus of claim 1, wherein the fixing portion comprises an operation piece and two extension pieces extending from opposite ends of the operation piece, the extension pieces are fixed to opposite sides of the connector in response to the fixing portion being rotated down to the position that the top wall of the holding portion is abutted against a top side of the memory card.

3. The mounting apparatus of claim 2, wherein two projections protrude from opposite sides of the connector, each extension piece defines a through hole in a lower portion, the projections are engaged in the through holes of the extension pieces in response to the fixing portion being rotated down to the position that the top wall of the holding portion is abutted against the top side of the memory slot.

4. The mounting apparatus of claim 3, wherein a pin protrudes from the connector adjacent to each projection, each pin is positioned above the corresponding projection and is farther from the fixing portion than the corresponding projection, an installing hole is defined in an upper portion of each extension piece and is away from the operation piece, the pins are pivotably inserted into the installing holes.

5. The mounting apparatus of claim 2, wherein the holding portion further comprises a connecting piece and two installing pieces extending from opposite sides of the connecting piece, the arm is perpendicularly connected to the connecting piece, a protrusion protrudes from an inner surface of each installing piece, each extension piece defines an installation hole adjacent to the operation piece, the protrusion is pivotably engages in a corresponding installation hole.

6. The mounting apparatus of claim 1, wherein the fixing portion is positioned below the top surface of the connector in response to the fixing portion being rotated down to the position that the top wall of the holding portion is abutted against the top side of the memory slot.

* * * * *